United States Patent [19]

Overkott

[11] Patent Number: 4,531,983

[45] Date of Patent: Jul. 30, 1985

[54] METHOD OF DEEP HARDENING OF WORKPIECES

[75] Inventor: Franz Overkott, Gevelsberg, Fed. Rep. of Germany

[73] Assignee: Firma Paul Ferd. Peddinghaus, Gevelsberg, Fed. Rep. of Germany

[21] Appl. No.: 514,353

[22] Filed: Jul. 15, 1983

Related U.S. Application Data

[63] Continuation of Ser. No. 182,136, Aug. 28, 1980, abandoned, which is a continuation-in-part of Ser. No. 78,773, Sep. 25, 1979, abandoned, which is a continuation of Ser. No. 804,431, Jun. 7, 1977, abandoned.

[30] Foreign Application Priority Data

Jun. 22, 1976 [DE] Fed. Rep. of Germany ..... 2627791
Oct. 9, 1979 [DE] Fed. Rep. of Germany ..... 2940826

[51] Int. Cl.[3] ..... C21D 1/74

[52] U.S. Cl. ..... 148/16; 148/16.7; 148/20.3; 148/134; 148/143

[58] Field of Search ..... 148/143, 134, 16, 16.7, 148/20.3

[56] References Cited

U.S. PATENT DOCUMENTS 3,997,376 12/1976 Hemsath et al. ..... 148/143

*Primary Examiner*—R. Dean
*Attorney, Agent, or Firm*—Toren, McGeady, Stanger

[57] ABSTRACT

A method for deep hardening steel workpieces which are subject to high surface pressures by first heating the workpiece and then quenching the thus heated workpiece to cool to a range just above the martensite stage, the temperature is held in this range by using a controlled cooling agent until the structure is essentially completely transformed to a fine particulate sorbite. Thereafter, the workpiece is cooled. As a result of this process, a uniform hardening pattern in the workpiece can be consistently obtained. An apparatus for carrying out the method of the invention is also disclosed.

9 Claims, 2 Drawing Figures

METHOD OF DEEP HARDENING OF WORKPIECES

CROSS-REFERENCE TO RELATED APPLICATIONS

This is a continuation of application Ser. No. 182,136, filed Aug. 28, 1980, now abandoned which, in turn, is a continuation-in-part of application Ser. No. 078,773, filed Sept. 25, 1979, now abandoned, which, in turn, is a continuation of application Ser. No. 804,431, filed June 7, 1977, now abandoned.

BACKGROUND OF THE INVENTION

1. Field of the Invention

The invention relates to a method for deep hardening steel workpieces for specifically high surface pressures wherein the workpiece is initially heated to the austenitizing temperature and is then quenched, and to an apparatus for carrying out this method having a heating device for heating the workpiece to the austenitizing temperature and a quenching path through which the workpiece is moved.

2. Description of the Prior Art

Workpieces which absorb high specific surface pressures in use must frequently be subjected to a so-called deep hardening in which hardening depths of 25 mm and more are achieved. When the hardening depth is this large, difficulties occur with respect to the hardening pattern. The desired hardening pattern is one which is uniform and falls off gradually without any great irregularities. However, heretofore, such a desired hardening pattern could not be achieved in a reliably reproducible manner.

In one known method, the deep hardening is achieved by subjecting the workpiece to a deep austenitizing and then quenching the workpiece to produce a martensitic structure. The workpiece is then tempered again using the residual heat still present in the workpiece. However, this method is not satisfactory.

Experiments have shown that a structure of a fine particulate sorbite offers better resistance to wear. However, in order to obtain this structure with as uniform as possible a hardening pattern was not heretofore possible in a reliably reproducible manner.

Experiments were carried out to obtain this structure by means of quenching with compressed air whose amount and pressure is controllable. This makes it possible to obtain a certain critical cooling rate through which high strengths can be obtained due to the formation of the desired sorbite structure. However, it was not possible to obtain a uniform hardening pattern with this method because the control of the compressed air was too slow or sluggish. In addition, the manipulation of the required compressed air is accompanied with such great noise that an industrial application is only possible with expensive protective measures.

Certain improvements in this connection are disclosed in German Offenlegungsschrift No. 26 27 791 wherein a cooling agent is admixed with the quenching medium. This made it possible to significantly reduce the amount of compressed air required and, thus, the annoyance caused by the noise. Moreover, the quenching rate can be controlled with greater sensitivity and speed.

Although it is possible to obtain high strengths by this method, its use has been limited thus far because a uniform hardening pattern could not be reproducibly achieved. Irregularities in the hardening pattern occurred time and again which may lead to crumbling and/or a loss in strength.

SUMMARY OF THE INVENTION

I have discovered a method for the deep hardening of workpieces which achieves the formation of fine particulate sorbite and produces a uniform hardening pattern which can be repeatedly obtained. I have further discovered an apparatus which is particularly suitable for carrying out this method.

In accordance with the invention, the desired result is obtained by a method in which the workpiece is initially quenched with a quenching medium to a range above the martensitic limit or level. The temperature of the workpiece is then held in this range by supplying a controllable cooling agent until the structure transformation to a fine particulate sorbite is essentially complete. Then the workpiece is further cooled. Preferably, quenching should be performed in such a way that the pearlite stage is avoided.

By dividing the quenching procedure into three stages, an extremely fine particulate sorbite structure of high strength and a uniform hardening pattern are achieved. The martensite stage is completely avoided by interrupting the quenching in the range of the intermediate stage and by supplying a controllable cooling agent for the time period until the complete transformation of the structure is reached.

The apparatus of the present invention is composed of a heating device for heating the workpiece to the austenitizing temperature, and a quenching path positioned thereafter. The workpiece is moved through the quenching path which is divided into at least two sections, the first of which is a quenching spray and the second, subsequent section being a controllable cooling spray.

DESCRIPTION OF THE PREFERRED EMBODIMENT

Figure 1:
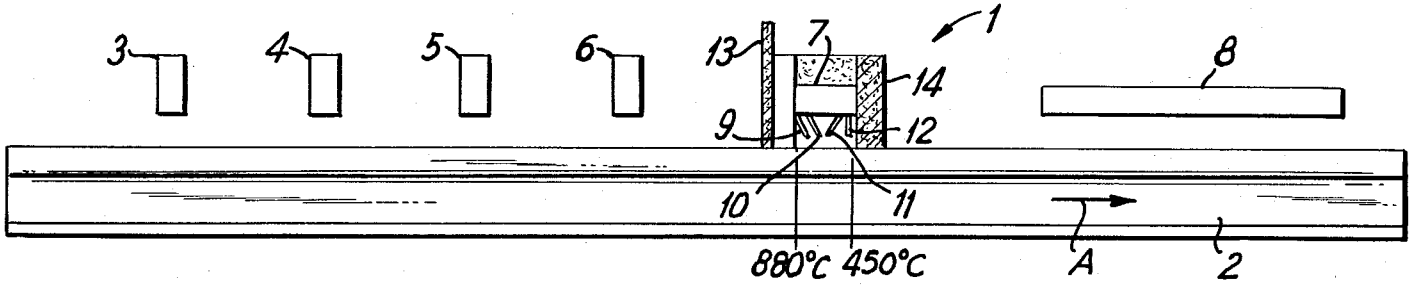
FIG. 1 is the side view of a hardening apparatus.

More particularly, in accordance with the present invention, the workpiece is first heated to a temperature between 800 to 1000 degrees C. and then quenched to a range above the martensitic limit or level. This limit is approximately 300 degrees celsius and preferably, the range above the martensitic level to which the workpiece is quenched is from 380–480 degrees C. The workpiece is ultimately cooled to room temperature.

The quenching of the workpiece takes place at a temperature range of about 350° to 480° C. in order to reach the intermediate stage. Compressed air has proved advantageous as the quenching medium because of its uniform cooling effect.

The cooling medium is preferably controlled by a measured admixing of a cooling agent with the quenching medium so that the removal of heat can be controlled very precisely and the noise can be reduced because significantly less air must be supplied. The use of uncooled compressed air and a cooled gas as the cooling agent has been found particularly advantageous, particularly from the standpoint of energy saving. As a measure of simplification, compressed air can also be used for the cooling agent.

To obtain effective control and a further reduction of noise, the cooling agent should have a temperature of below 0° C., and preferably significantly lower than 0° C., e.g., to about −80° C.

The apparatus for carrying out the method according to the invention has a heating device for heating the workpiece to the austenitizing temperature and a quenching path through which the workpiece is moved. This apparatus has a quenching path which is divided into at least two sections, namely a quenching spray and a subsequent, controllable cooling spray. By means of the former spray, the workpiece can be quickly quenched to a range above the martensite stage, while the removal of heat can be controlled through the subsequent controlled cooling spray in such a manner that the temperature is kept approximately constant until the complete transformation of the structure has been reached.

The quenching spray is advantageously constructed as a compressed air spray. It may comprise a plurality of successively arranged rows of nozzles. In this regard, it has been found especially advantageous to successively arrange four rows of nozzles, wherein the two rows located in the front at the inlet are obliquely inclined in the direction of travel of the workpiece and the two rows located at the rear are inclined against the direction of travel. This makes it possible to achieve a uniform quenching of the workpiece and, as a result, also a uniform hardening pattern. The angles of the axes of action of the nozzles relative to the vertical can be between 0° and 25°.

For protection against noise and smoke, the quenching spray is desirably enclosed, for example, by means of asbestos plates. In this manner, the annoyance caused by noise and smoke is reduced to an acceptable and permissible degree.

Finally, the invention provides that the cooling spray is composed of an elongated compressed air spray with a cooling unit for a portion of the compressed air. In this manner, the workpiece can be kept under the influence of the cooling spray until the transformation of the structure is completed. The cooling unit provides a cooling agent which, in this case, is compressed air, as is the normal cooling medium.

FIG. 1 is a schematic illustration of a hardening apparatus 1 for the deep hardening of an elongated workpiece 2 which is moved in the direction of arrow A. The hardening apparatus has, as viewed in the direction of travel, three successive preheating burners 3, 4, 5, a hardening burner 6, a quenching spray 7 and a cooling spray 8.

During the advance of the workpiece, the preheating burners 3, 4, 5 and the main burner 6 heat the workpiece 2 to the austenitizing temperature, about 850° C., while it is quickly cooled down in the region of the quenching spray 7 to about 450° C., i.e., to a range above the martensite stage and within the intermediate stage.

For this purpose, the quenching spray 7 has four successive rows of nozzles, 9, 10, 11, 12. The first two rows 9, 10, located at the inlet side are obliquely inclined toward the outlet and the third row 11 is inclined against the direction of travel, while the last row 12 is aligned approximately vertically. In this manner, an optimum quenching pattern in the workpiece 2 is achieved.

Due to the generation of significant noise, the quenching spray 7 is enclosed with asbestos plates 13, 14 at the front and the rear and at the two sides. These plates reduce the noise level to such an extent that further protective measures are not required.

Following the quenching spray 7, the workpiece 2, or the area of the workpiece to be treated, e.g., a rail head, in the illustrated example, travels through the elongated cooling spray 8. This spray has the sole purpose of keeping the temperature of the workpiece 2 essentially constant, i.e., in the range of about 350° to 480° C., and particularly, of preventing the temperature from falling into the martensite range. Accordingly, the cooling spray 8 removes the residual heat still present in the workpiece 2 only to the extent that the temperature does not drop in the treatment region.

For this purpose, the cooling spray 8 has compressed air nozzles, not shown in detail, through which a mixture of cooled and uncooled compressed air is directed toward the workpiece. The compressed air, cooled to a temperature of far below 0° C. by means of a cooling unit serves as a cooling agent to be admixed with the cooling medium. In the present case, this is also compressed air. As a result, the required amount of air and the resulting noise can be significantly reduced. Additionally, precise control of the temperature and the amount of the cooling medium can be achieved by an appropriate control of the supply of the cooling agent depending on the amount of heat to be removed. The length of the cooling spray 8 is adjusted so that after it has been passed, the transformation of the structure into a fine particulate sorbite is concluded, so that, subsequently, any additional cooling can be effected through conventional means.

Figure 2:
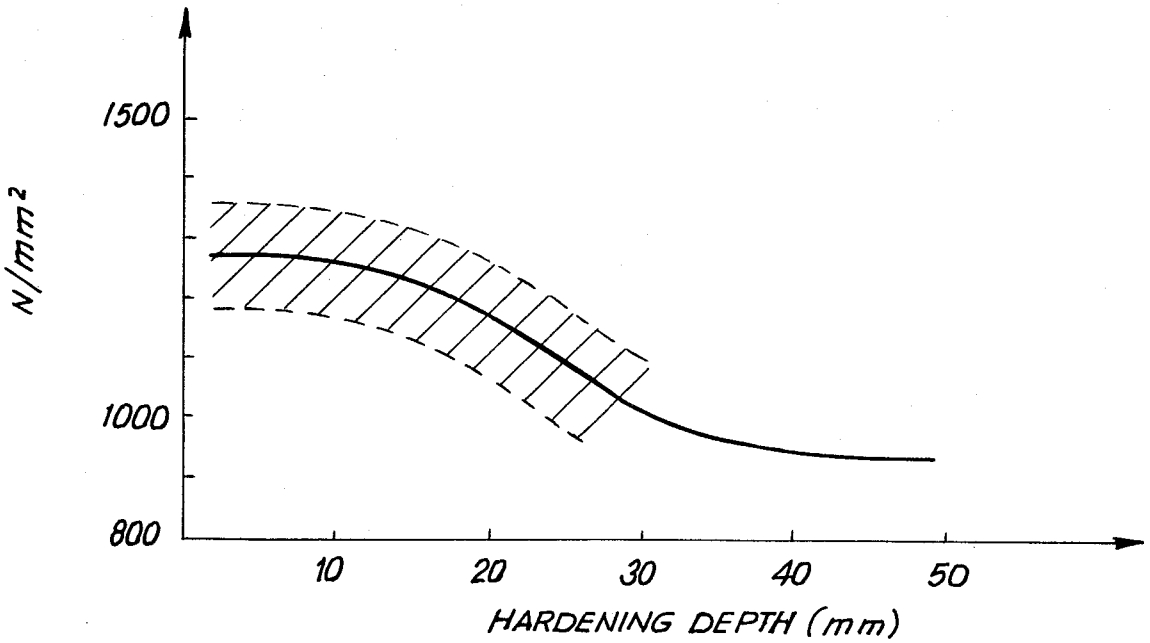
FIG. 2 shows the hardening pattern of a workpiece after passing through the hardening apparatus according to FIG. 1.

FIG. 2 shows a diagram in which the distance from the surface of the workpiece 2, i.e., the hardening depth, is plotted on the abscissa, and the respective hardness is plotted on the ordinate. The cross hatching indicates the hardening pattern of a workpiece 2, a rail head in the present case, which has been hardened in the hardening arrangement 1 according to FIG. 1. The diagram shows that the determined values are situated within a narrow, reproducible range and are near and partially on the ideal hardening curve which is illustrated by a solid line.

What is claimed is:

1. In a method of deep hardening of metal workpieces which must absorb specifically high surface pressures in use wherein the workpiece is initially heated to the austenitizing temperature and is subsequently quenched, the improvement which comprises initially quenching the workpiece with a quenching medium to a range above the martensitic limit and maintaining the temperature in this range with a controlled cooling medium until the transformation of the structure to a fine particulate sorbite has been substantially completed and then further cooling the workpiece, wherein the temperature of the cooling medium is controlled by admixing a cooling agent therewith and uncooled compressed gas is used as the cooling medium and cooled gas is used as the cooling agent.

2. The method of claim 1 wherein the workpiece is quenched to the intermediate stage in a manner so that the pearlite stage is avoided.

3. The method of claim 1 or 2 wherein the initial quenching cools the workpiece to a temperature in the range from about 350° to 450° C.

4. The method of claim 1 or 2 wherein the quenching medium is compressed air.

5. The method of claim 1 or 2 wherein uncooled compressed air is used as the cooling medium and cooled compressed air is used as the cooling agent.

6. The method of claim 1 or 2 wherein the cooling medium is controlled by admixing a cooling agent therewith and the cooling agent has a temperature of below 0° C.

7. The method of claim 1 or 2 wherein the cooling medium is controlled by admixing a cooling agent therewith and the cooling agent has a temperature of −80° C.

8. The process of claim 1 wherein the workpiece is first heated to a temperature between 800° to 1000° C. and is then quenched to a range about 300° C.

9. The process of claim 8 wherein the workpiece is quenched to a range from about 380° to 480° C.

* * * * *